US008175510B2

(12) United States Patent
Nagase

(10) Patent No.: US 8,175,510 B2
(45) Date of Patent: May 8, 2012

(54) FIXING DEVICE, AND IMAGE FORMING APPARATUS EQUIPPED THEREWITH

(75) Inventor: Hisayoshi Nagase, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 413 days.

(21) Appl. No.: 12/437,331

(22) Filed: May 7, 2009

(65) Prior Publication Data

US 2009/0279929 A1 Nov. 12, 2009

(30) Foreign Application Priority Data

May 12, 2008 (JP) ..... 2008-124524

(51) Int. Cl.
*G03G 21/00* (2006.01)

(52) U.S. Cl. ..... 399/351; 399/346; 399/329; 219/216

(58) Field of Classification Search ..... 399/122, 399/320, 327–331, 335, 338, 343, 346, 350–351; 219/216, 244
See application file for complete search history.

(56) References Cited

U.S. PATENT DOCUMENTS

2006/0245798 A1* 11/2006 Nakayama ..... 399/329
2007/0231026 A1* 10/2007 Hayashi et al. ..... 399/329

FOREIGN PATENT DOCUMENTS

JP 2002-357968 12/2002
JP 2004-191744 7/2004

* cited by examiner

*Primary Examiner* — David Porta
*Assistant Examiner* — Benjamin Schmitt
(74) *Attorney, Agent, or Firm* — Finnegan, Henderson, Farabow, Garrett & Dunner, L.L.P.

(57) ABSTRACT

A fixing device includes: a fixing member that touches an unfixed toner image formed on a sheet; a pressing member that causes the sheet to come in pressure contact with the fixing member; a pressing belt that is interposed between the fixing member and pressing member to rotate; a lubricant coating member that coats lubricant on an inner surface of the pressing belt; a pair of first blade members each that touches, through a counter method, an inner surface of both edge portions of the pressing belt in a width direction perpendicular to a rotating direction of the pressing belt, to scrape the lubricant; and a first lubricant guide member arranged from a tip of the first blade members to an inner side, receives the scraped lubricant, and guides the lubricant to the inner side to return to the inner surface of the pressing belt.

13 Claims, 7 Drawing Sheets

FIXING DEVICE, AND IMAGE FORMING APPARATUS EQUIPPED THEREWITH

This application is based on Japanese Patent Application No. 2008-124524 filed on May 12, 2008, which is incorporated hereinto by reference.

BACKGROUND OF THE INVENTION

The present invention relates to a fixing device that is mounted on an image forming apparatus such as a copying machine, a printer, a facsimile machine and a multifunction peripheral equipped with functions of the aforesaid items, and fixes an unfixed toner image formed on a transfer material by pressing and heating the unfixed toner image with a fixing member and a pressing member, and to an image forming apparatus equipped with the aforesaid fixing device.

Until now, a heat roller fixing device in which a pressing roller having an elastic layer is brought into pressure contact with a fixing roller kept to the prescribed temperature has been employed widely for machines from a low-speed one to a high-speed one, or from a monochrome machine to a color machine, for image forming apparatuses of an electrophotographic type such as a copying machine, a printer, a facsimile machine and a multifunction peripheral having functions of the aforesaid items.

In the conventional heat roller fixing device, a transfer material on which an unfixed toner image is formed is conveyed to a fixing nip section formed by a fixing roller and a pressing roller, to fix the toner image on the transfer material through actions of pressing and heating. However, this method has a problem that this method is disadvantageous on the point of power saving because it is necessary to heat a fixing roller whose heat capacity is great for giving actions of pressing and heating to toner on the transfer material. There is further a problem that heating of the fixing roller is time-consuming in the case of printing, namely, a period of time up to the start of printing (warm-up time) is long.

In recent years, there have been proposed a fixing device of a belt fixing type wherein a pressing belt with low heat capacity is used and warm-up time is hardly needed to realize quick start and power saving, and an image forming apparatus, and they are used.

In the aforesaid fixing device, if friction between an inner surface of the pressing belt and a pressure contact member is great, running of the pressing belt is interrupted to cause troubles in fixing and paper creasing, because a heating roller and a pressing belt are constructed to be brought into pressure contact each other by a pressure contact member.

Therefore, in the case of a fixing device used for a conventional image forming apparatus, there is a construction to supply lubricant to the inner surface of the pressing belt for reducing the friction caused between the pressing belt and a pressure contact member and thereby for making smooth running of the pressing belt possible.

In this construction, however, there is a problem that lubricant moves gradually to an end portion of the pressing belt in the course of repeating fixing processing, and the lubricant oozes out from the edge portion of the pressing belt to stick to a recording sheet or to make the inside of the apparatus dirty.

To solve the aforesaid problem, a lubricant leakage preventing device is provided at least one of an outer circumferential surface of a belt guide member that supports both edge portions of the pressing belt and an inner circumferential surface of a pressing belt, in the fixing device proposed in Unexamined Japanese Patent Application Publication No. 2002-357968.

Fixing device proposed in Unexamined Japanese Patent Application Publication No. 2004-191744 is the one wherein a liquid repelling section that repels lubricant is provided at each of both edge portions on the inner surface of the pressing belt.

However, in the fixing devices shown in Unexamined Japanese Patent Application Publication Nos. 2002-357968 and 2004-191744, lubricant that moves to the edge portion of the pressing belt is pushed back and lubricant leakage is prevented, but the action assignment to prevent lubricant leakage and to make smooth running of the pressing belt possible are not attained sufficiently. Therefore, there is considered the construction wherein paired blades are brought into contact with an inner surface of the pressing belt, or with the surface of a supporting roller, at both edge areas of the pressing belt, for scraping lubricants to return them to lubricant coating member or to the central side on an inner surface of the belt, which exhibits a certain effects.

However, there occurred a problem that the effects are not exhibited sufficiently, in the case of the structure of arrangement wherein an end face line on the tip of the blade (a line advancing from an edge touching the pressing belt to a free edge on the tip of the blade) faces downward from the horizontal line, or a tip of the blade faces downward. In a word, big restrictions have come into being on the arrangement structure of a fixing device of a pressing belt type.

A cause for the foregoing was found to be the fact that lubricant scraped off by a touching edge of the blade flowed down through an end surface of a tip of the blade to drip from the aforesaid free edge, and it was supplied again to the position that is substantially the same as before in the width direction on an inner surface of the pressing belt. Namely, there was a situation wherein an original function to return the lubricant scraped off by the blade to the lubricant coating member or to the central direction on an inner surface of the pressing belt was not exhibited because the lubricant scraped off by a tip of the blade was returned to the pressing belt in the same position in the width direction.

SUMMARY OF THE INVENTION

An object of the invention is to prevent leakage of lubricant from an edge portion of the pressing belt and to prevent that lubricant sticks to a recording sheet and contaminates the inside of the apparatus. Further, its objective is to construct stably a circulation system for lubricant wherein lubricant collected by a lubricant leakage prevention such as paired blades is returned to a lubricant coating member, or to the central direction of a pressing belt. Further object is to prevent lubricant leakage on both edge portions in the axial direction of a supporting roller that supports an inner surface of the pressing belt.

An object of the invention is to provide an image forming apparatus equipped with a fixing device forming an image with high image quality, by preventing contamination of a recording sheet and the inside of the apparatus.

One aspect for attaining the aforesaid objective is as follows.

A fixing device having therein a fixing member that touches an unfixed toner image formed on a sheet, a pressing member that causes the sheet to come in pressure contact with the aforesaid fixing member and a pressing belt that is interposed between the aforesaid fixing member and pressing member to rotate, wherein there are provided a lubricant coating member that coats lubricant on an inner surface of the pressing belt, at least paired first blade members that touch, through a counter method, an inner surface of both edge portions in the width direction perpendicular to the rotating direction of the pressing belt, to scrape the aforesaid lubricant and a first lubricant guide member that is arranged from a tip of the first blade member to the inner side in the width direction, and receives the lubricant scraped by the first blade member, then, guides it to the inner side in the width direction to return it to the inner surface of the pressing belt.

Another aspect is an image forming apparatus characterized to be equipped with the fixing device described above.

DETAILED DESCRIPTION OF THE PREFERRED EMBODIMENTS

An embodiment of the invention will be explained as follows. Incidentally, the description of the present paragraph does not limit a technical scope and term meaning of claims.

[Image Forming Apparatus]

Figure 1:
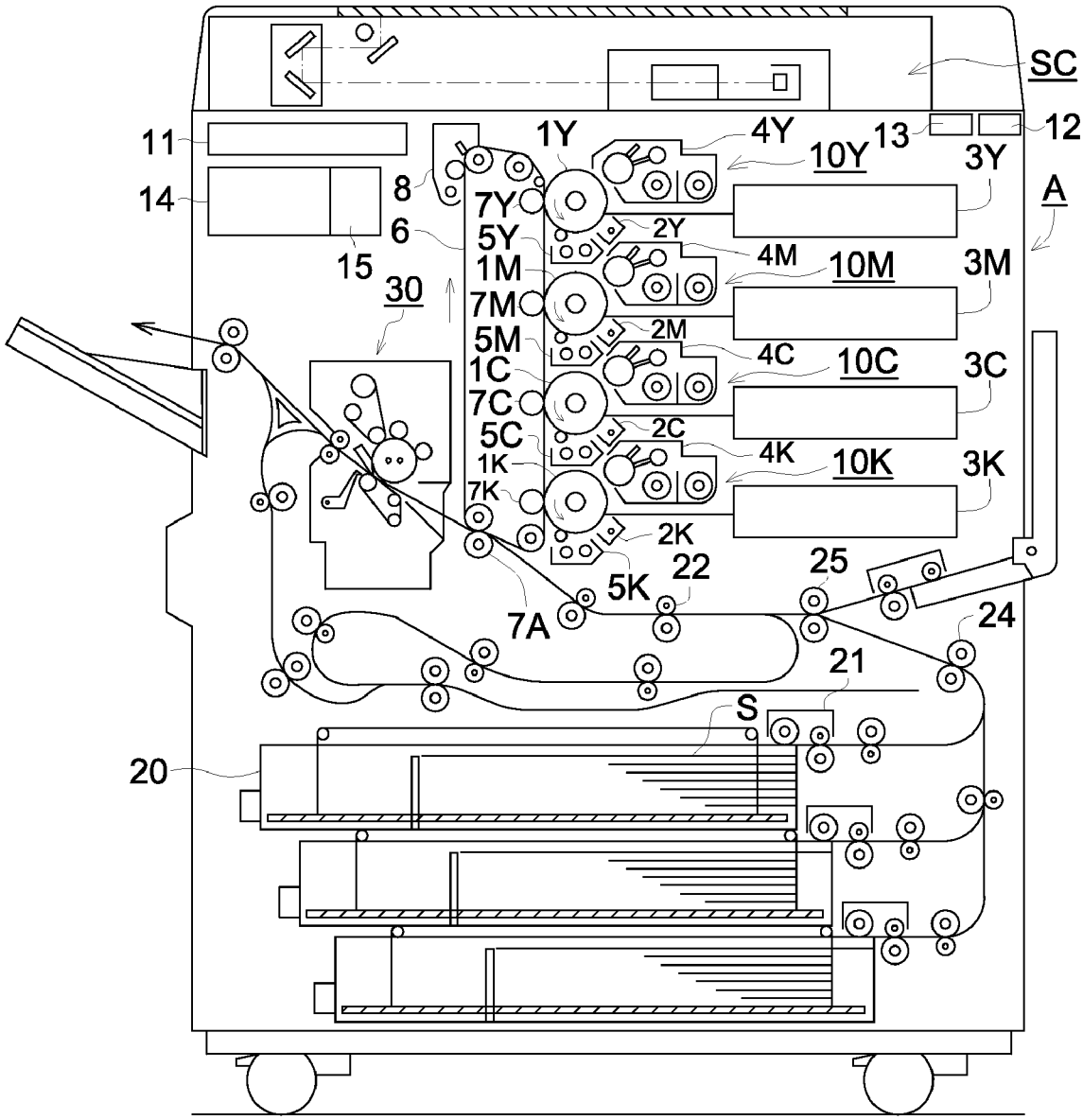
FIG. 1 is a structural diagram of an image forming apparatus relating to an embodiment of the present invention.

FIG. 1 is a structural diagram of an image forming apparatus relating to an embodiment.

Image forming apparatus A is one called a color image forming apparatus of a tandem type, and it is composed of plural sets of image forming devices 10Y, 10M, 10C and 10K and of a transfer material sheet feed conveyance device and fixing device 30.

With respect to an original document placed on a document platen, an image of the original document is given scanning exposure by an optical system of an original document image scanning exposure apparatus of image reading apparatus SC, to be read into a line image sensor. The original document which has been read into the line image sensor is converted in a photoelectric manner into original document data respectively in Y color, M color, C color and K color, which are transferred to an image processing section. In the image processing section, original document data in respective colors are subjected to analog processing, A/D conversion, shading correction and image compression processing, and they are stored temporarily in a storage section. Based on a directive of printing for original document, original document data in respective colors in the storage section are inputted respectively in optical writing devices 3Y, 3M, 3C and 3K.

Image forming device 10Y that forms an image in yellow (Y) color has therein charging device 2Y, optical writing device 3Y, developing unit 4Y and cleaning device 5Y which are arranged on a circumference of image carrier 1Y. Image forming device 10M that forms an image in magenta (M) color has therein image carrier 1M, charging device 2M, optical writing device 3M, developing unit 4M and cleaning device 5M. Image forming device 10C that forms an image in cyan (C) color has therein image carrier 1C, charging device 2C, optical writing device 3C, developing unit 4C and cleaning device 5C. Image forming device 10K that forms an image in black (K) color has therein image carrier 1K, charging device 2K, optical writing device 3K, developing unit 4K and cleaning device 5K.

The charging device 2Y and the optical writing device 3Y constitute a latent image forming device, the charging device 2M and the optical writing device 3M constitute a latent image forming device, the charging device 2C and optical writing device 3C constitute a latent image forming device and the charging device 2K and the optical writing device 3K constitute a latent image forming device.

A sign 4Y represents a developing unit that houses two-component developer composed of yellow (Y) toner with a small particle size and of carrier, a sign 4M represents a developing unit that houses two-component developer composed of magenta (M) toner with a small particle size and of carrier, a sign 4C represents a developing unit that houses two-component developer composed of cyan (C) toner with a small particle size and of carrier and a sign 4K represents a developing unit that houses two-component developer composed of black (K) toner with a small particle size and of carrier.

Intermediate transfer member 6 is trained about a plurality of rollers, and is supported in a rotatable manner.

Images each being in each color formed respectively by image forming devices 10Y, 10, 10C and 10K are transferred onto rotating intermediate transfer member 6 one after another respectively by primary transfer devices 7Y, 7M, 7C and 7K, thus, composite color images are formed.

Recording sheet S housed in sheet feeding cassette 20 is fed by sheet feeding device (first sheet feeding section) 21, and then, is conveyed to secondary transfer device 7A through registration roller (second sheet feeding section) 22, thus, a color image is transferred onto the recording sheet S. The recording sheet S on which the color image has been transferred is interposed in fixing device 30 where heat and pressure are applied on the recording sheet S and the toner image thereon is fixed, thus, the recording sheet S is ejected out of the apparatus.

On the other hand, after the color image is transferred onto the recording sheet S by secondary transfer device 7A, toner remaining on intermediate transfer member 6 from which the recording sheet S has been separated is removed by cleaning device 8.

Operation display section 11 mounted on an upper part of image forming apparatus A has a transfer material selecting and setting device which sets various types of recording sheet S such as plain paper and coated paper, and also sets a thickness (basis weight) of recording sheet S and a size and the number of sheets of recording sheet S.

Further, in the vicinity of the upper portion of the main body of the image forming apparatus A, there are arranged a main power supply switch that turns on and turns off main power supply 12 which practices image forming processing and an alternate power supply switch that turns on and turns off alternate power supply 13 which practices power saving mode. Inside the main body of the image forming apparatus A, there are arranged control device 14 that controls fixing device 30 and storage device 15 that stores the state of on and off for the main power supply 12 and for the alternate power supply 13.

Meanwhile, although the image forming apparatus A was explained referring to the occasion of color image forming, an occasion of forming a monochrome image is also included in the invention.

[Fixing Device]

Figure 2:
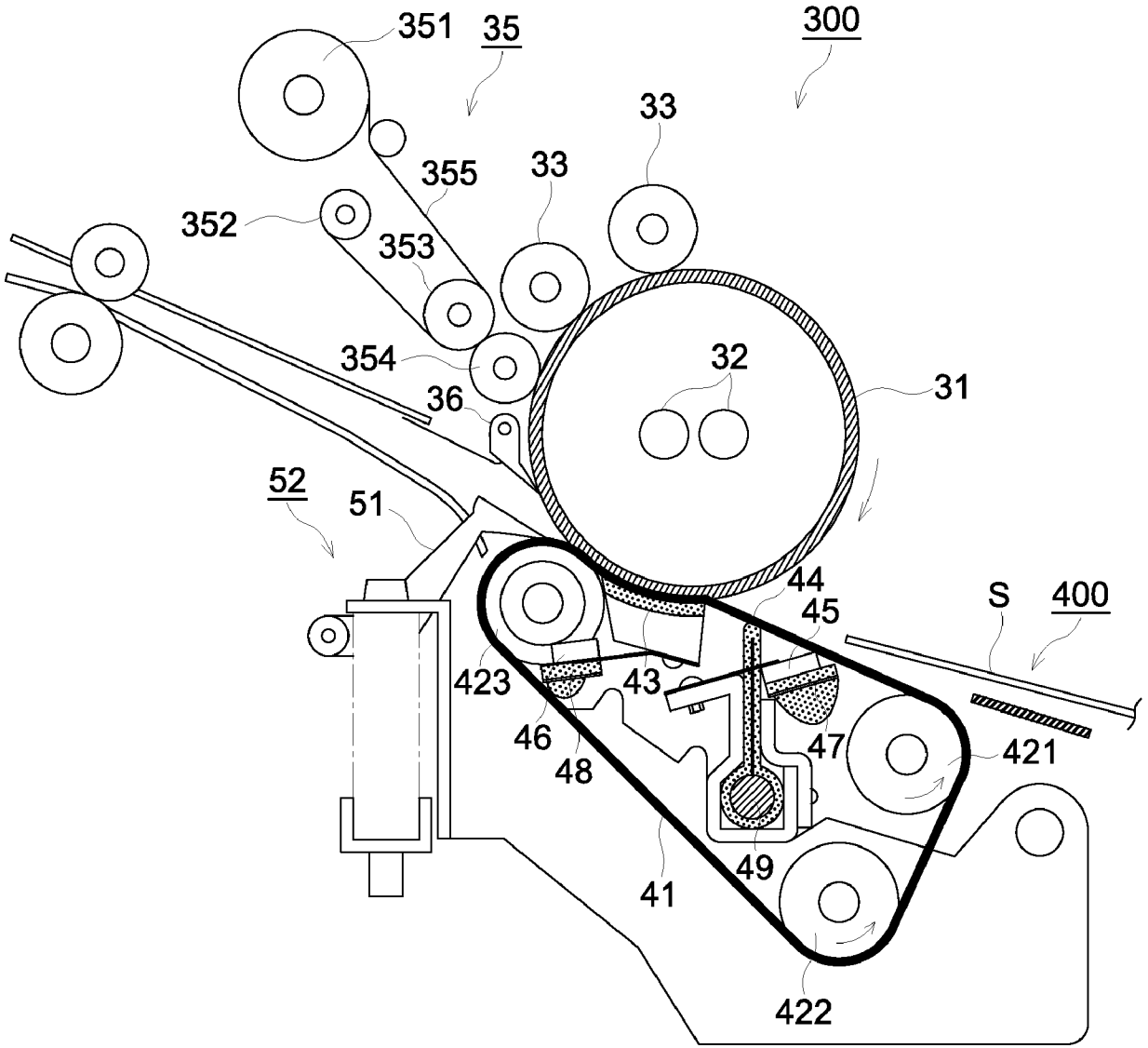
FIG. 2 is a cross-sectional diagram of a fixing device relating to the embodiment.

FIG. 2 is a cross-sectional diagram of a fixing device 30 relating to the invention.

The fixing device 30 relating to the invention has therein heating device 300 located in the upper portion of a sheet passing path and pressing device 400 located in a lower portion of the sheet passing path. The heating device 300 has heating roller (fixing member) 31 or the like. The pressing device 400 has pressing belt 41.

A monochrome image or a multicolor image on the recording sheet S is fixed by heating and pressing through a fixing nip portion formed between heating roller 31 and pressing belt 41.

Inside the heating roller 31, there are arranged two heating sources 32, and on an outer circumferential surface of the heating roller 31, there are arranged two external heating sources 33. On an outer circumferential surface of the heating roller 31, there are arranged cleaning device 35, separation claw 36 and an unillustrated temperature sensor. The cleaning device 35 is composed of web master roll 351, web take-up portion 352, web depressing roller 353, cleaning roller 354 and of cleaning web 355.

The separation claw 51 comes in contact with an outer circumferential surface of pressing belt 41 that is trained about separation roller 423, and separates a leading edge of recording sheet S from the pressing belt 41.

Depressing device 52 holds the pressing device 400 having pressing belt 41 in a way of free ascent and descent, ant causes the pressing belt 41 to come in pressure contact with the heating roller 31.

Figure 3:
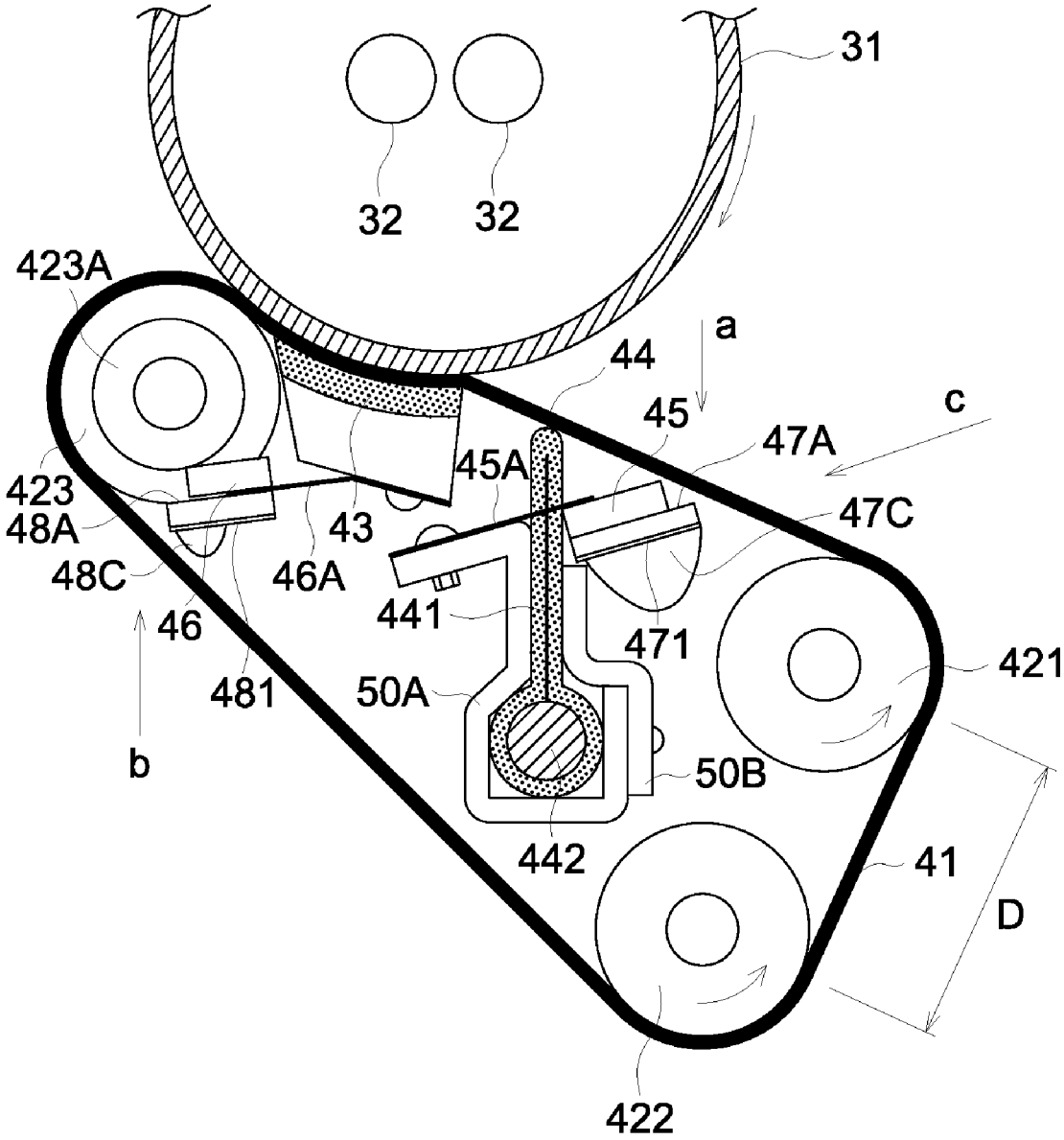
FIG. 3 is an enlarged cross-sectional diagram of pressing device 400 of a fixing device relating to the embodiment.

Next, pressing device 400 will be explained in detail as follows. FIG. 3 is an enlarged cross-sectional diagram of the pressing device 400, and the explanation will be given based on FIG. 3.

The pressing belt 41 is trained about a periphery of supporting roller (hereinafter referred to as an entrance roller) 421 that is close to an introduction portion for recording sheet S, a periphery of separation roller 423 that is close to an exit portion for recording sheet S, and about a periphery of tension roller 422, to be tensional, and it comes in contact with an outer circumferential surface of heating roller 31.

Depressing and touching member (also referred to as pad or pressing member) 43 presses an inner surface side of pressing belt 41 trained between entrance roller 421 and separation roller 423, and causes it to come in pressure contact with an outer circumferential surface of heating roller 31. A surface layer on the edge portion of the internal surface of pressing belt 41 is covered by a fluroric resin layer. By covering the surface layer with the fluroric resin layer, wettability for lubricant is lowered, and an oil film is hardly caused, which eliminates passing through of lubricant in an area where lubricant is scraped off described later, and prevents leakage of lubricant.

Lubricant coating member 44 and first blade member 45 are arranged between depressing and touching member 43 and entrance roller 421 on the inner surface side of pressing belt 41, and these members are formed to be an integrated unit. By integrating these members, a channel for collecting lubricant can be made compact. Further, maintenance of unit replacement can be carried out simultaneously.

Lubricant coating member 44 is one wherein nonwoven fabric such as a sheet of an aramid fiber is folded and edge portions are joined together, and a lower portion is formed to be in a form of a sack.

An inside in the form of a sack at the lower portion of the lubricant coating member 44 constitute a lubricant supply section in which foaming materials 442 such as foaming agents of felt or silicone rubber are inserted. Lubricants in sufficient amount are impregnated in lubricant coating member 44 and in foaming agents 442 (lubricant supply section) in advance. A structure of the section in a form of a sack in this case is one wherein no lubricant leaks outside.

In the intermediate portion of lubricant coating member 44, there is provided stainless steel thin plate 441, and elastic force of the stainless steel thin plate 441 causes a tip of the folded portion of the lubricant coating member 44 to touch the inner surface of the pressing belt 41, thus, lubricant in an appropriate amount is coated on the inner surface of the pressing belt stably.

Supporting member 50A holds the lubricant coating member 44 by cramping supporting member 50B with screws.

First blade member 45 is mounted on the upper portion of supporting member 50A. On the first blade member 45, a stainless steel plate (for example, SUS301, thickness 0.05 mm, length 12 mm, width 15 mm) and a blade made of fluorine elastomer (hardness Hs 70, thickness 2 mm, width 15 mm, length 5 mm) are glued together. A tip portion of the first blade member 45 is positioned to be in upstream side of the tip portion of the lubricant coating member 44 in the direction of rotation of pressing belt 41 to be outside of a rubbing area of the lubricant coating member 44, and it comes in pressure contact with the neighborhood of both edge portions of the pressing belt 41. A tip portion of the first blade member 45 comes in pressure contact with the inner surface side of the pressing belt 41 by a "counter method", to scrape lubricant sticking to the inner surface side of the pressing belt 41. For example, an angle of touching the pressing belt is 25° therefrom, and suppress strength is 15 g in weight.

In this case, the pressure contact by the "counter method" implies that the first blade member 45 comes in pressure contact with an inner surface of the pressing belt 41 counter to the moving of the pressing belt 41.

Lubricant scraped off the pressing belt 41 by the tip of the first blade member 45 is caused by gravity to flow down through the edge face on the tip. First lubricant guide member 47 is arranged at the lower section of the first blade member 45 to receive the aforesaid lubricant flowing down. The first lubricant guide member 47 is mounted on the first blade member 45 so that the first lubricant guide member 47 may touch the surface (surface opposite to the surface facing the pressing belt 41) on the bottom side of the first blade member 45. The first lubricant guide member 47 is integrated with the first blade member.

The first lubricant guide member 47 is made of a fiber such as nonwoven fabric of an aramid fiber or of a porous member such as silicone sponge. Since the aforesaid materials are those in which lubricant such as silicone oil has high wettability, lubricants are contained evenly in the whole of the first lubricant guide member 47. Therefore, even in the case of maintenance of fixing device 30 or of replacement thereof, lubricant neither gets wet nor leaks.

Supporting member 50A holds lubricant coating member 44 by means of fixing supporting member 50B with screws. Since the first blade member 45 is fixed on the bent portion at the upper part of the supporting member 50A as stated above, the lubricant coating member 44, the first blade member 45 and the first lubricant guide member 47 are of the integrated unit construction, and simultaneous maintenance can be realized with replacement of the unit.

Next, spatial and positional relationship of the first lubricant guide member 47 will be explained.

The first lubricant guide member 47 is supported upward by supporting member 471 that is made of highly heat-resistant resin (molded goods, sheet-processed goods) such as, for example, PPS (polyphenylenesulfide), PAI (polyamideimide), PI (polyimide), PEEK (polyetheretherketone) and liquid crystal polymer. The supporting member 471 is fixed on the first blade member by means of screw cramp, in a way to hold the first lubricant guide member 47. Therefore, the spatial and positional relationship of the first lubricant guide member 47 is prescribed by a shape of the supporting member 471.

Figure 4:
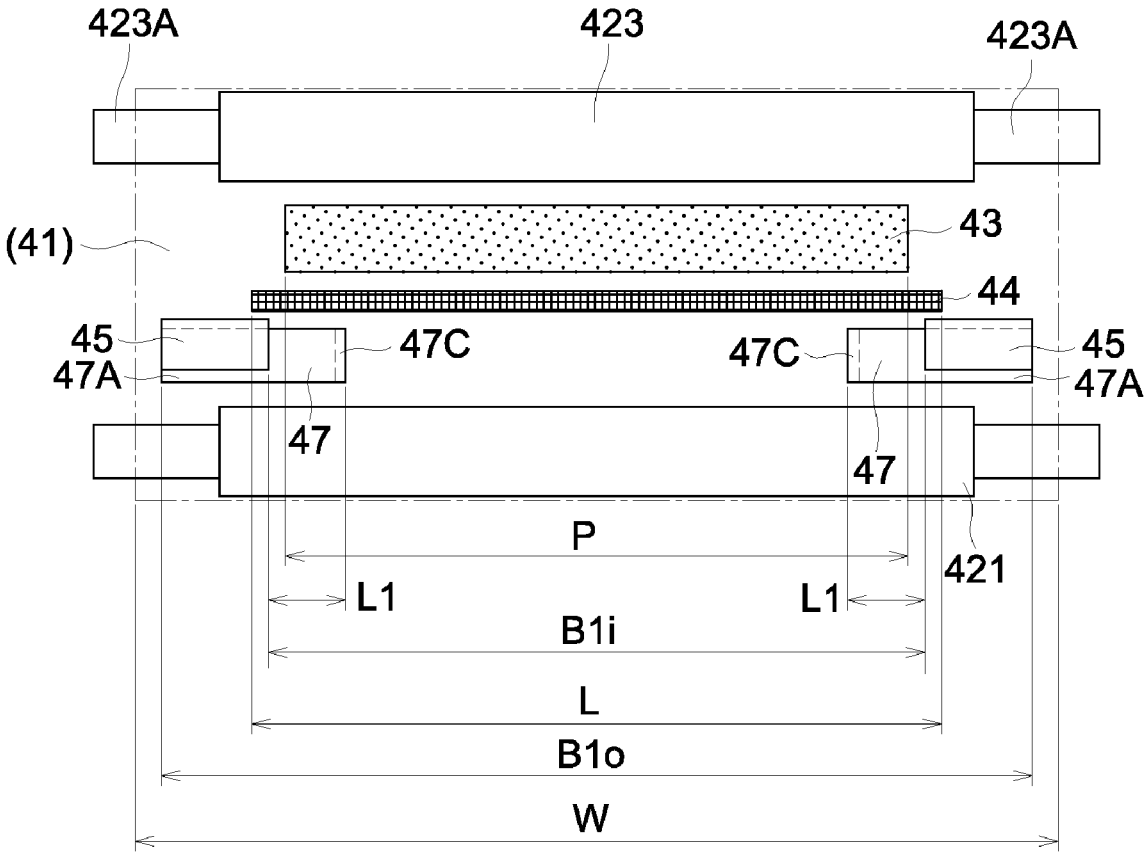
FIG. 4 is a pattern diagram (diagram viewed in the direction of arrow "a") showing relationship between first blade member and first lubricant guide member in the lubricant leakage prevention technology relating to the embodiment.

FIG. 4 is a pattern diagram showing relationship between first blade member 45 and first lubricant guide member 47 which is viewed in the direction of arrow "a" in FIG. 3.

The supporting member 471 is extended by L1 (for example, 30 mm) toward the center side in the width direction from the position of the first blade member 45. The supporting member 471 supports, on its upper surface, the first lubricant guide member 47. The first lubricant guide member 47 is further extended from an end portion on the center side of the supporting member 471 toward the center side of the first lubricant guide member 47 to hang down to form hung portion 47C spatially.

Figure 6:
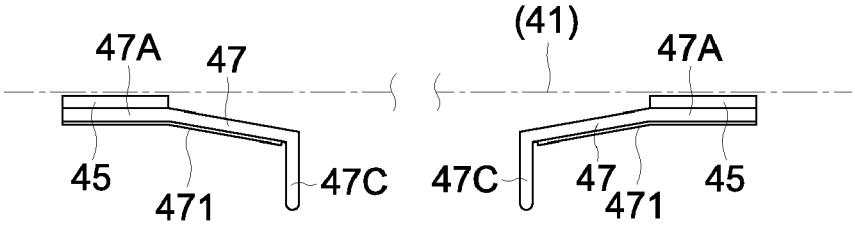
FIG. 6 is a pattern diagram (diagram viewed in the direction of arrow "c") showing relationship between first blade member and first lubricant guide member.

FIG. 6 is a pattern diagram showing relationship between first blade member 45 and first lubricant guide member 47 which is viewed in the direction of arrow "c" in FIG. 3.

The supporting member 471 is in a form that is inclined downward with development to the center side (inner side). Therefore, the first lubricant guide member 47 is supported by the supporting member 471 to hang down at the end portion on the center side, thereby, to form hung portion 47C.

Further, the supporting member 471 is protruded from the tip of the first blade member 45 toward the upstream side in the direction of movement of the pressing belt, as shown in FIGS. 3 and 4. Therefore, the first lubricant guide member 47 can be arranged stably even at the upstream side of the tip of the first blade member 45 by the support of the supporting member 471. Then, lubricant receiving section 47A is arranged at the upstream side of the first blade member 45 in the first lubricant guide member 47.

Owing to the spatial arrangement of the first lubricant guide member 47 mentioned above, lubricant scraped off pressing belt 41 flows down on the end face on the tip of the first blade member 45 to be collected into the lubricant receiving section 47A of the first lubricant guide member 47.

Then, the lubricant is absorbed in the first lubricant guide member 47 made of nonwoven fabric, then, is developed to the center side in the width direction to move the hung portion 47C.

The lubricant scraped off is returned to the inner surface of the pressing belt that is located to the inner side by an amount of L1 (for example, 30 mm) from an end portion on the inner side of the first blade member 45, through the aforesaid path.

By arranging the first lubricant guide member 47 to be tilted downward toward the inner side as shown in FIG. 6, actions of gravity are added to actions of getting wet for lubricant, which, therefore, makes it possible to move to the center side more smoothly.

On hung portion 47C, actions of gravity are added, and lubricants in a large quantity are collected and drop in a form of a liquid droplet. Then, lubricants arrive at an inner surface of pressing belt through a tension roller.

In the case of the construction wherein guidance to the inner surface of the belt through mediation of a tension roller is not preferable, it is also possible to arrange an unillustrated fixed member so that it may cover the tension roller.

A part of lubricant moved to both edge portions of pressing belt 41 here and there after being coated on an inner surface of pressing belt 41 by lubricant coating member 44 in the aforesaid construction is scraped surely off the inner surface of the pressing belt 41 by the first blade member 45. After that, the lubricant thus scraped off is supplied again surely by the first lubricant guide member 47 to the inner surface of a pressing belt located at a center position that is away by L1 (mm) from an edge portion in an inner side of the first blade member 45. Owing to cooperation of the aforesaid first blade member 45 and the first lubricant guide member 47, leakage of lubricant and sticking to recording sheet can be prevented.

Further, a part of lubricant stuck to the inner surface of pressing belt 41 moves here and there also to shaft end portion 423A of separation roller 423. If this is left alone, respective portions of a fixing device are contaminated. It is therefore necessary to return the lubricant stably to the center side of the inner surface of scraping and pressing belt. In the case of FIG. 3, there is provided the construction wherein the second blade member 46 is caused to touch shaft end portion 423A from the lower side by a counter method. The lubricant scraped by the second blade member 46 is caused by gravity to flow down through the edge face, without moving to the center side on the edge surface on the tip of the second blade member 46. For returning this lubricant on an inner surface of pressing belt 41 after receiving the lubricant surely and moving to the center side, the second lubricant guide member 48 having the same structure as that of the aforesaid first lubricant guide member 47 is installed on the lower side of the aforesaid second blade member 46.

Figure 5:
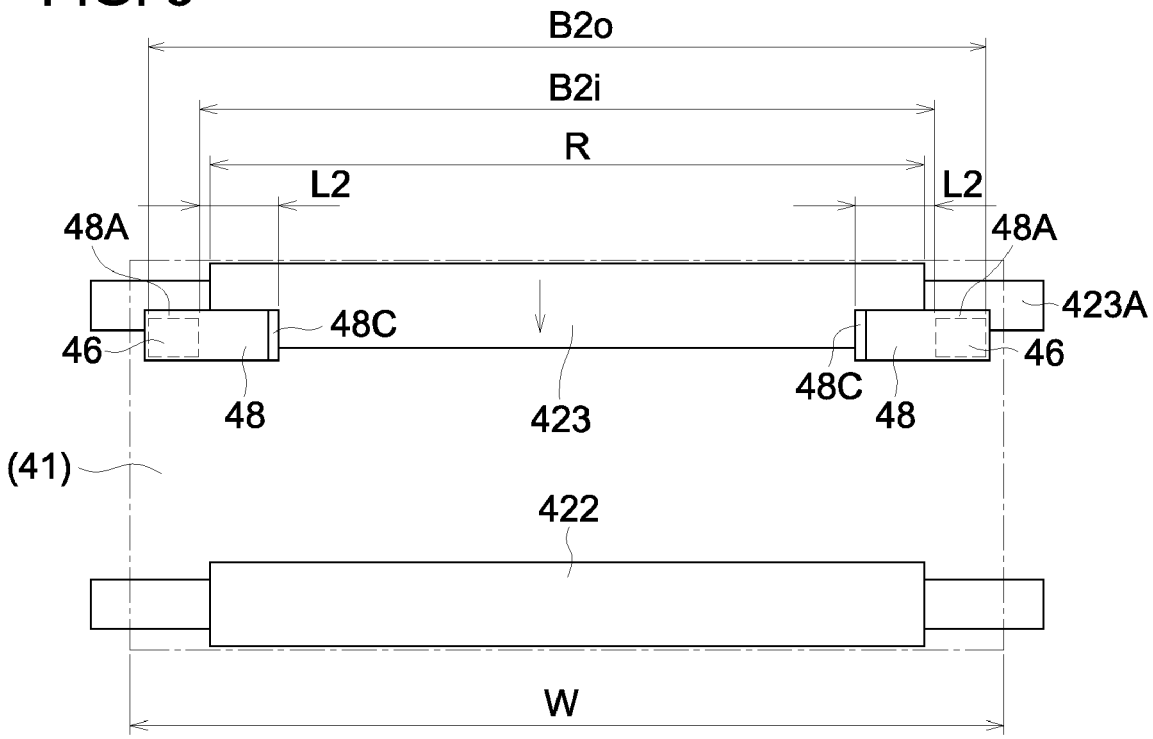
FIG. 5 is a pattern diagram (diagram viewed in the direction of arrow "b") showing relationship between second blade member and second lubricant guide member in the lubricant leakage prevention technology relating to the embodiment.

FIG. 5 is a pattern diagram showing relationship between second blade member 46 and second lubricant guide member 48 viewed in the direction of arrow "b" in FIG. 3.

With respect to separation roller 423, the direction of an arrow shown on separation roller 423 in FIG. 5 has been moved. The second blade member 46 is positioned between the second lubricant guide member 48 and separation roller 423, as shown with broken lines in FIG. 5.

With respect to the second lubricant guide member 48, its lubricant receiving section 48A is protruded from a blade tip portion, and it receives surely the lubricant that has flowed down on an edge surface of the tip of the second blade member 46.

The second lubricant guide member 48 is supported upward by supporting member 481 that is made of highly heat-resistant resin (molded goods, sheet-processed goods) such as, for example, PPS (polyphenylenesulfide), PAI (polyamideimide), PI (polyimide), PEEK (polyetheretherketone) and liquid crystal polymer, and positional relationship is prescribed. In a word, the supporting member 481 is mounted on the second blade member 46 by means of screws to hold the second lubricant guide member 48.

The supporting member 481 extends toward the center side in the width direction from a position of the second blade member 46 by L2 (mm), to support the second lubricant guide member 48 on its upper face. The second lubricant guide member 48 further extends from an end portion on the center side of the supporting member 481, to hang downward. It hangs down spatially to form hung portion 48C.

The supporting member 481 has the same form as that in supporting member 471 in FIG. 6, and it is in a downward inclination form in which displacement is conducted downward with advancement toward the center side (inner side) from a position of the second blade member.

Incidentally, the second blade member 46 that is integrated with the second lubricant guide member 48 is supported by a supporting member for pressing and rubbing member (pad or pressing member) 43 by means of screws.

In the aforesaid construction, a part of lubricant moved to shaft end portion 423A of the separation roller 423 here and there, after being coated on an inner surface of pressing belt 41 by lubricant coating member 44 is scraped off the shaft end portion 423A by the second blade member 46. After that, the lubricant thus scraped off is supplied again surely by the second lubricant guide member 48 to the inner surface of a pressing belt located at a center position that is away by L2 (mm) from an edge portion in an inner side of the second blade member 46. Owing to cooperation of the aforesaid second blade member 46 and the second lubricant guide member 48, leakage of lubricant and sticking to recording sheet can be prevented. In this embodiment, the separation roller 423 is one example of the supporting roller.

In FIG. 4, positional relationship in the width direction perpendicular to the direction of movement of pressing belt 41 among the first blade member 45, the first lubricant guide member 47 and lubricant coating member will be explained.

An inner space of the paired first blade members 45 that come in contact with pressing belt 41 is represented by B1*i* and an outer space is represented by B1*o*. A pressure contact width with which the pressing belt 41 is caused by pressing and rubbing member 43 to come in pressure contact with heating roller 31 (FIG. 2) is represented by P. A width of coating with which the lubricant coating member 44 coats lubricant on an inner surface of pressing belt 41 is represented by L. A space between hung portion 47C of the first lubricant guide member and an inner end portion of the first blade member 45 is represented by L1. A space between the first blade member 45 and an outer end portion of the first lubricant guide member 47 is represented by B1*o*.

Figure 7:
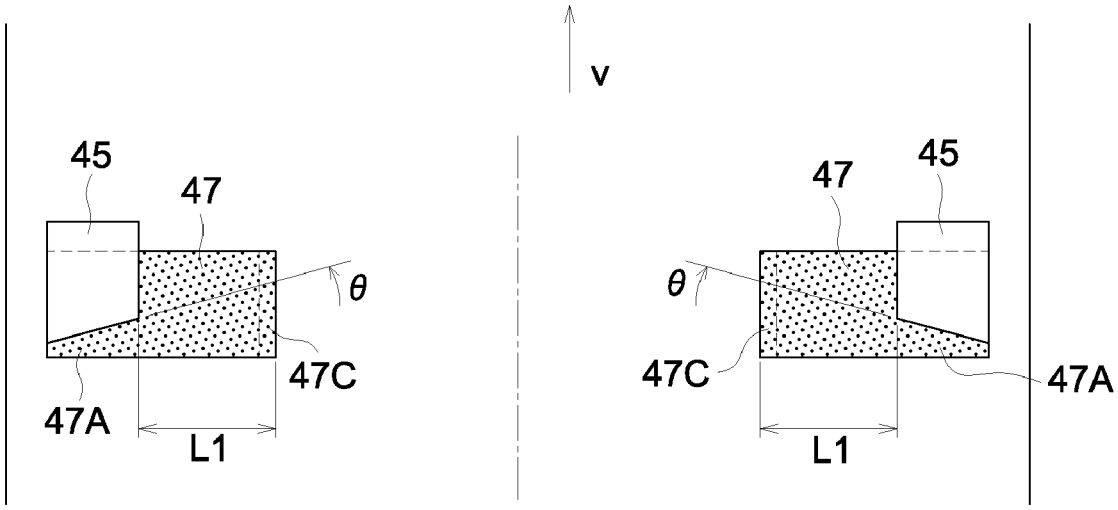
FIG. 7 is a pattern diagram (diagram viewed in the direction of arrow "a") showing relationship between another first blade member and first lubricant guide member relating to the embodiment.

FIG. 7 is a pattern diagram concerning an embodiment in the case where a tip portion of the first blade member 45 is tilted from the width direction perpendicular to the direction of rotation of pressing belt 41, in which the pressing belt 41 is seen through in the direction of arrow "a" in FIG. 3. Arrow "v" represents the direction in which the pressing belt 41 moves.

A shape of a tip portion of the first blade member 45 is a tilted surface that has tilt angle θ wherein its inner side portion is shorter than its outer side portion in the direction perpendicular to the direction of rotation of pressing belt 41.

When a tilted surface whose tilt angle θ is 4° or higher is established, it is effective to collect lubricant to the center, and it is more effective to prevent leakage of lubricant. However, when a tip surface of the first blade member draws near a vertical line, the collected lubricant flows down on the tip surface immediately, which reduces effects of inclination of angle θ. Therefore, it is possible to say positively that the method to return lubricant to the inner side of pressing belt 41 by the first blade member 45 alone is one having no freedom degree about a position to install the first blade member 45.

The tilt angle θ is established to be 4° or higher and to be lower than 30°. The forefront of an outer side portion of the first blade member 45 rubs an inner surface in the vicinity of both edge portions in the width direction of the pressing belt 41. On the tilted surface having tilt angle θ of 30° or higher, effects to prevent leakage of lubricant is lowered because a width of the blade to touch grows greater, although an effect to collect lubricant to the center grows greater.

The construction to attach the first lubricant guide member 47 from the lower side as shown in FIG. 3 for the aforesaid first blade member whose tip portion is tilted is effective.

The lubricant scraped off an inner surface of pressing belt 41 by the first blade member 45 flows down on a tip surface while being collected to the inner side along the tip surface of the first blade member that is tilted by angle θ, and it arrives at receiving section 47A of the first by both actions of wetting and gravity to arrive at hung portion 47C of the first lubricant guide member through the first 4 lubricant guide member 47, and the lubricant becomes a liquid-drop to fall. Therefore, the lubricant thus scraped off can be supplied again surely to the inner surface of the pressing belt that is located by L1 (mm) from the inner side of the first blade member.

In FIG. 5, positional relationship among second blade member 46, second lubricant guide member 48 and separation roller 423 in the width direction perpendicular to the direction of movement of pressing belt 41 will be explained.

The pressing belt 41 is supported by separation roller 423 and tension roller 422.

The pressing belt 41 is supported by outside diameter of the separation roller 423, and a width of the outside diameter of the separation roller 423 is represented by R. A supporting section of the separation roller 423 is smaller than the outside diameter.

The second blade member 46 comes in contact with a supporting section of separation roller 423. An inner side space of the second blade member 46 is represented by B2*i* and a space of its outer side end portion is represented by B2*o*. A space between hung portion 48C of the second lubricant guide member and an inner side edge portion of the second blade member 46 is represented by L2.

Within a range where the aforesaid L1 and L2 are large to a certain extent, the larger they are, the more preferable it is, and it is the best if the size is about 10 mm or more. It is preferable that each of L1 and L2 is a distance wherein hung portion 48C of the second lubricant guide member becomes to be inside of the outside edge portion of lubricant coating member 44 than the outside. By creating the positional relationship of this kind, it is possible to make resupplying to an inner surface of pressing belt 41 to be equivalent substantially to returning to lubricant coating member 44 or to returning to lubricant supply section 442.

When a tip portion of receiving section 47A of the first lubricant guide member comes in contact with pressing belt 41, the lubricant scraped off the inner surface of pressing belt 41 by the first blade member 45 arrives at a tip portion through receiving section 47A, to be supplied again to an inner surface of the pressing belt 41 that moves through the position on the upstream side of the first blade member 45. As a result, a function to return lubricant to the central side (objective of the invention) is extremely lowered, and lubricant leaks out of the first blade member 45. Therefore, it is preferable that a tip portion of the receiving section 47A of the first lubricant guide member is protruded from the tip of the first blade member 45 by a length by which the tip portion of the receiving section 47A of the first lubricant guide member does not touch the inner surface of the pressing belt, as shown in FIG. 3.

Further, it has been confirmed that the lubricant does not leak from the first blade member to the outside even when a tip portion of the receiving section 47A of the first lubricant guide member touches the pressing belt 41 because of an arrangement of the first blade member 45, provided that a space of 1 mm to about 3 mm is provided between the outermost end portion of the receiving section 47A of the first lubricant guide member and an outside end portion of the first blade member 45. When the aforesaid touch occurs, or when the touch is feared, it is preferable to establish a space like that mentioned above.

The relationship stated above is the same as that for the second blade member 46, the second lubricant guide member 48 and the receiving section 48A.

By providing the first lubricant guide member 47 and the second lubricant guide member, it has become possible to prevent problems of lubricant contamination including leaking out of lubricant scraped by the first blade member 45 and the second blade member 46, lubricant sticking to recording sheet S by making a detour from an edge portion of pressing belt 41 and contamination of the inside of the apparatus.

Figure 8:
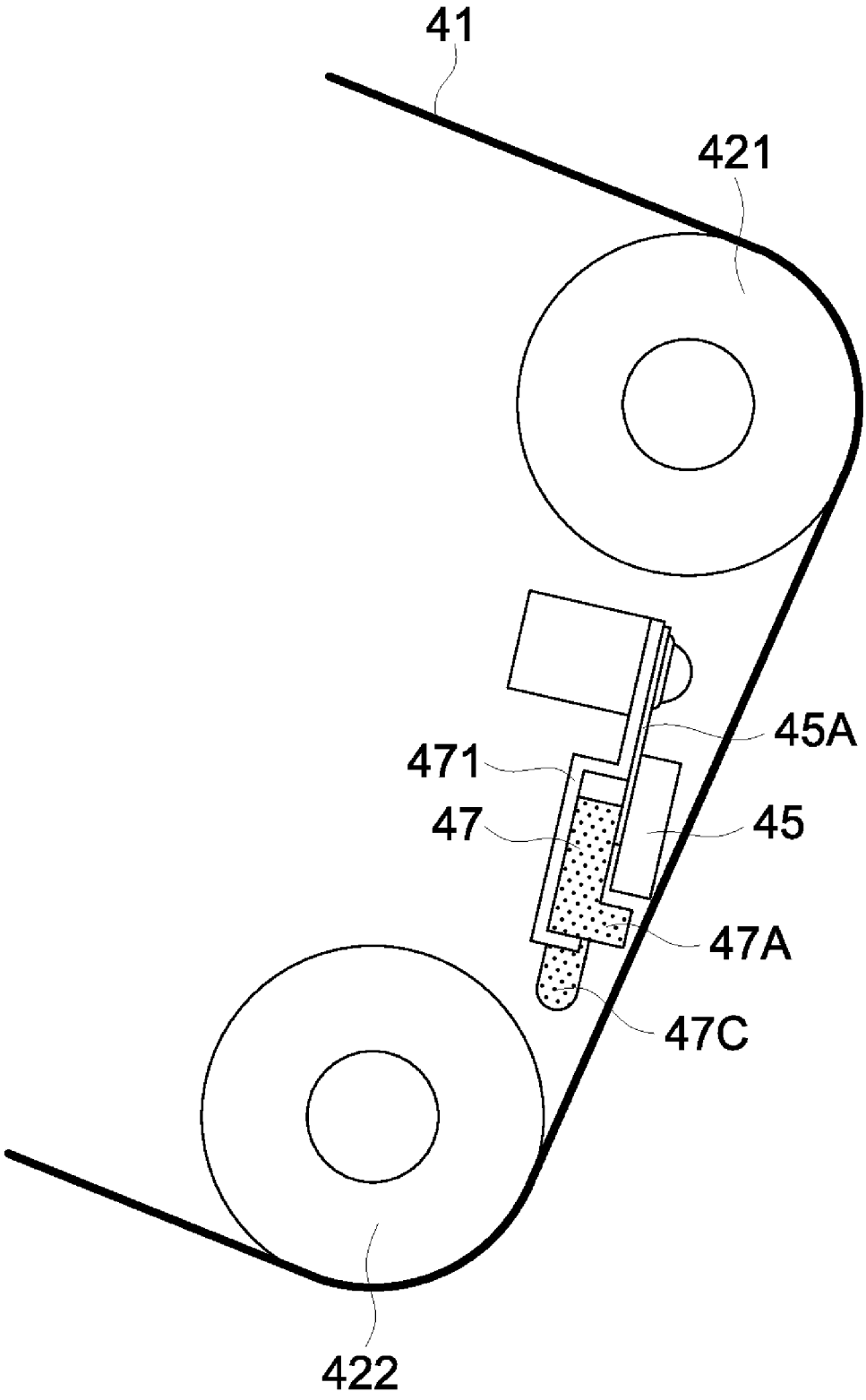
FIG. 8 is a cross-sectional diagram showing another embodiment of the lubricant leakage prevention technology relating to the embodiment.

FIG. 8 shows an embodiment of the invention wherein the first blade member 45 and the first lubricant guide member 47 are provided between entrance roller 421 and tension roller 422. This can be applied to a layout wherein center distance D between entrance roller 421 and tension roller 422 is great. Under this construction, receiving section 47C of the first lubricant guide member is located under the tip portion of the blade member 45 so that it can receive lubricant scraped.

As stated above, the construction of the first blade member and the first lubricant guide member is of a technology that can be applied to any arrangement for the inner surface of the pressing belt and can prevent lubricant leakage and lubricant contamination.

In the embodiment shown above, the construction is one wherein lubricant scraped by the first blade member and the second blade member is returned from hung portion 47C of the first lubricant guide member and from hung portion 48C of the second lubricant guide member to the inner surface of the pressing belt 41. However, the invention is not limited to this construction, and it also includes the construction to supply to the center side of the inner surface of the pressing belt here and there, through another guide mechanism. For example, the construction to return to lubricant supply section 442 of the lubricant coating member 44 is also included in the invention.

In the aforesaid explanation relating to the invention, the first lubricant guide member 47 is integrated with the first blade member 45, or the second lubricant guide member 48 is integrated with the second blade member 46, to which, however, the invention is not limited, and they may be separated.

In the aforesaid explanation relating to the invention, the first lubricant guide member 47 and the second lubricant guide member 48 are supported respectively by supporting member 471 and supporting member 481 for prescribing positions spatially, to which, however, the invention is not limited. For example, the first and second lubricant guide members may be caused to adhere directly and partially to blade members. Or, the first and second lubricant guide members may be in forms wherein they are fixed to positions spatially by thermal molding processing, without using supporting members.

The fixing device and the image forming apparatus in the present embodiment exhibit the following two effects with the constructions mentioned above.

1. Lubricant leakage from an edge portion of the pressing belt can be prevented by scraping lubricant on the edge portion on an inner surface of the pressing belt by a blade. It is possible to build up stably a circulatory configuration for lubricant wherein lubricant scraped off by a blade is received by a lubricant guide member, and lubricant scraped off by the blade is returned to a lubricant coating member through a lubricant guide member. As a result, there are no problems that lubricant sticks to a recording sheet or an inside of the apparatus is contaminated by lubricant, and lubricant can be coated stably for a long time. Further, a decline of durability of a pressing belt caused by wear of pressing and rubbing member on an inner surface of a pressing belt and deterioration of lubricant caused by worn powder are prevented.

2. An image forming apparatus equipped with a fixing device that can form images with high image quality by preventing a disfiguring stain on a recording sheet and in the inside of the apparatus.

What is claimed is:

1. A fixing device comprising:

(a) a fixing member that touches an unfixed toner image formed on a sheet;

(b) a pressing member that causes the sheet to come in pressure contact with the fixing member;

(c) a pressing belt that is interposed between the fixing member and pressing member to be rotated;

(d) a lubricant coating member that coats lubricant on an inner surface of the pressing belt;

(e) a pair of first blade members that each touch, through a counter method, an inner surface of both edge portions of the pressing belt in a width direction perpendicular to a rotating direction of the pressing belt, to scrape the lubricant; and (f) a first lubricant guide member that is arranged spreading from a tip of each of the first blade members to an inner side in the width direction, and receives the lubricant scraped by the first blade member, then guides the lubricant to the inner side in the width direction to return to the inner surface of the pressing belt.

2. The fixing device of claim 1, wherein the first lubricant guide member comprises a hung portion provided on the inside of the first blade member in the width direction.

3. The fixing device of claim 1, wherein the first lubricant guide member comprises a portion inclined downward toward the inner side of the width direction.

4. The fixing device of claim 1, wherein the first lubricant guide member is provided on the first blade member.

5. The fixing device of claim 1, wherein a part of the first lubricant guide member is in contact with a tip portion of the first blade member.

6. The fixing device of claim 1, wherein the first lubricant guide member is provided below the first blade member.

7. The fixing device of claim 1, further comprising:

a pair of second blade members each provided in the vicinity of the first blade member, that touch, through a counter method, each of both edge portions of a supporting roller which rotatably supports the pressing belt, in a direction perpendicular to a rotating direction of the supporting roller, to scrape the lubricant stuck to the supporting roller; and a second lubricant guide member that is arranged spreading from a tip of each of the second blade members to the inner side in the width direction, and receives the lubricant scraped by the second blade members, then guides the lubricant to the inner side in the width direction to return to the inner surface of the pressing belt.

8. The fixing device of claim 7, wherein the second lubricant guide member comprises a hung portion provided on the inside of the second blade member in the width direction.

9. The fixing device of claim 7, wherein the second lubricant guide member comprises a portion inclined downward toward the inner side of the width direction.

10. The fixing device of claim 7, wherein the second lubricant guide member is provided on the second blade member.

11. The fixing device of claim 7, wherein a part of the second lubricant guide member is in contact with a tip portion of the second blade member.

12. The fixing device of claim 7, wherein the second lubricant guide member is provided below the second blade member.

13. An image forming apparatus comprising the fixing device of claim 1.

* * * * *